US007836793B2

(12) United States Patent
Borene et al.

(10) Patent No.: US 7,836,793 B2
(45) Date of Patent: Nov. 23, 2010

(54) CONTAINER CLOSURE SOUND-OUTPUTTING AND DISCONNECTING ARTICLE AND METHOD

(75) Inventors: Randolph Borene, 5021 Mertola, El Dorado Hills, CA (US) 95762; Howard I. Finelt, Sherman Oaks, CA (US)

(73) Assignee: Randolph Borene, Eldorado Hills, CA (US)

( * ) Notice: Subject to any disclaimer, the term of this patent is extended or adjusted under 35 U.S.C. 154(b) by 0 days.

(21) Appl. No.: 11/936,653

(22) Filed: Nov. 7, 2007

(65) Prior Publication Data

US 2009/0114065 A1 May 7, 2009

(51) Int. Cl.
*B67B 7/14* (2006.01)

(52) U.S. Cl. ..... 81/3.4; 81/3.36; 81/3.29

(58) Field of Classification Search ..... 81/3.4, 81/3.41, 3.44, 3.36, 3.37, 3.29, 3.33
See application file for complete search history.

(56) References Cited

U.S. PATENT DOCUMENTS

| | | | | |
|---|---|---|---|---|
| 4,525,878 | A * | 7/1985 | Lowe, Jr. | 2/209.13 |
| 4,606,245 | A * | 8/1986 | Veverka et al. | 81/3.36 |
| 4,756,214 | A * | 7/1988 | Valtri et al. | 81/3.4 |
| 4,833,948 | A | 5/1989 | Jones | |
| 4,836,060 | A | 6/1989 | Klefbeck | |
| 5,489,893 | A | 2/1996 | Jo et al. | |
| 5,851,042 | A * | 12/1998 | Bankuty et al. | 294/106 |
| 6,041,532 | A | 3/2000 | Pollhaus et al. | |
| 6,862,960 | B2 | 3/2005 | Chung | |
| 7,069,813 | B2 | 7/2006 | Cheung | |
| 2005/0204877 | A1 * | 9/2005 | Royko | 81/479 |
| 2006/0266161 | A1 | 11/2006 | Mulcaire | |
| 2008/0110298 | A1 * | 5/2008 | Monk | 81/3.08 |

FOREIGN PATENT DOCUMENTS

| | | | | |
|---|---|---|---|---|
| EP | 0279194 | * | 8/1988 | 81/3.09 |
| WO | 87/05002 A1 | | 8/1987 | |

OTHER PUBLICATIONS

International Search Report dated Jan. 8, 2009, pp. 1-2.

* cited by examiner

*Primary Examiner*—D. S Meislin
(74) *Attorney, Agent, or Firm*—Howard N. Sommers

(57) ABSTRACT

An article for enabling disconnection of a closure from a container, and the output of sound thereupon. The article includes a closure capture enabling element, for enabling capture of the closure, and a handle, connected to the closure capture enabling element, for enabling movement of the closure capture enabling element for capture, disconnection, and removal of the closure thereby relative to the container. It also includes a sound outputting circuit, for enabling sound to be outputted upon capture and movement of the closure in a direction for enabling disconnection of the closure from the container, and a sound outputting actuation enabling element, for enabling actuation of the sound outputting element.

29 Claims, 4 Drawing Sheets

38
32
18
10
36
24
20
64
34
16
42
28
22
40
50
44
48
46
26
30
12
14

CONTAINER CLOSURE SOUND-OUTPUTTING AND DISCONNECTING ARTICLE AND METHOD

BACKGROUND OF THE INVENTION

1. Field of the Invention

This invention is generally related to the removal of a closure from a container, and more particularly, to an article and method for disconnecting a closure from a container and outputting sound thereupon.

2. General Background and State of the Art

A closure such as a cork has been used in conjunction with a container such as a wine bottle to provide the benefit of an inert means for sealing the wine bottle. Natural cork has long been used for its original preferability, as well as its traditional appeal. However, wine spoilage as a result of tainting has been attributed to natural cork closures.

One of the appealing features of a natural cork stopper is the sound it makes as it is removed from an unopened bottle of wine. Another appealing feature of a natural cork stopper is the relative ease of removal, due to its inherent physical properties, when compared with the removal of similar stoppers made from synthetic material.

A corkscrew is a device that is used to uncork a bottle of wine, so as to remove the cork from the bottle. A basic corkscrew model consists of a metal spike in the shape of an open spiral (helix) connected to a handle. The user centers the point of the helix on the top of the cork and twists until the wire has become securely embedded in the body of the cork. Securing the bottle with one hand, the user then pulls on the handle until the cork has been released. The cork can then be removed from the corkscrew and examined or discarded.

Wine experts estimate that pulling a cork out of a bottle with a corkscrew requires the same force as lifting 100 pounds. For this reason, many mechanical improvements have been made to the traditional corkscrew design. Some provide more leverage for pulling out the cork, while others emphasize more torque during twisting.

Waiters who routinely open and pour corked wine bottles carry a lever corkscrew. The worm (the helix-shaped screw) is twisted into the cork as before, but the waiter uses a side-mounted lever to lift the cork out in one fluid motion. Further refinements led to a corkscrew with a double lever action. Two wings are mechanically drawn upwards by a gear as the worm drills into the cork. The user steadies the bottle on a table and presses down on both wings. The cork is pulled straight out by the central gear assembly. An even more recent corkscrew design uses both increased torque and a vertical lever to pull up on the cork.

Using a corkscrew properly can prevent some of the most common wine-opening hazards. An inferior corkscrew with a solid auger design instead of an open spiral can dig out too much cork, which could lead to contamination of the bottle. Drilling completely through the soft center of an older wine bottle may also lead to problems with cork pieces and damage the pulling. Those who are uncomfortable with using a traditional corkscrew may use a self-centering double lever system or a vertical lever corkscrew.

Screw top caps have been introduced to utilize their inert qualities in interfacing with aging beverages such as wine. Screw top caps for wine bottles have become increasingly popular for all types of wines. Wineries have begun to replace corked bottles with screw tops.

The reason for the shift from cork to metal screw caps is that an increased amount of wine is being contaminated by cork taint, leaving the wine tasting musty and dull. The culprit for this unpleasant phenomenon is trichloroanisole (TCA), a compound formed when chlorine used for bleaching reacts with mould already growing in the cork. Humans are very sensitive to the compound and can detect it even at weak dilutions. TCA can flourish in several areas of a bottling facility, such as drains and barrels, but corks pose the biggest problem. The problem of tainted corks is on the increase because cork manufacturers are finding it increasingly hard to find supplies of good quality cork to meet demand.

It would therefore be desirable to provide an article for enabling disconnecting of a closure from a container, such as disconnecting a screw cap from a wine bottle, and for outputting sound thereupon, such as the sound of a cork popping, or a user-recordable output.

Invention Summary

Briefly, and in general terms, the present invention, in a preferred embodiment, by way of example, is directed to an article for enabling disconnection of a closure from a container, and the outputting of sound thereupon. The article includes a closure capture enabling element, for enabling capture of the closure, and a handle, connected to the closure captive enabling element, for enabling movement of the closure capture enabling element for capture, disconnection, and removal of the closure thereby relative to the container.

The article further includes a sound outputting circuit, for enabling sound to be outputted upon capture and movement of the closure in a direction for enabling disconnection of the closure from the container, and a sound outputting actuation enabling element, for enabling actuation of the sound outputting element.

These and other aspects and advantages of the invention will become apparent from the following detailed description and the accompanying drawings, which illustrate by way of example the features of the invention.

DETAILED DESCRIPTION OF THE PREFERRED EMBODIMENTS

Figure 1:
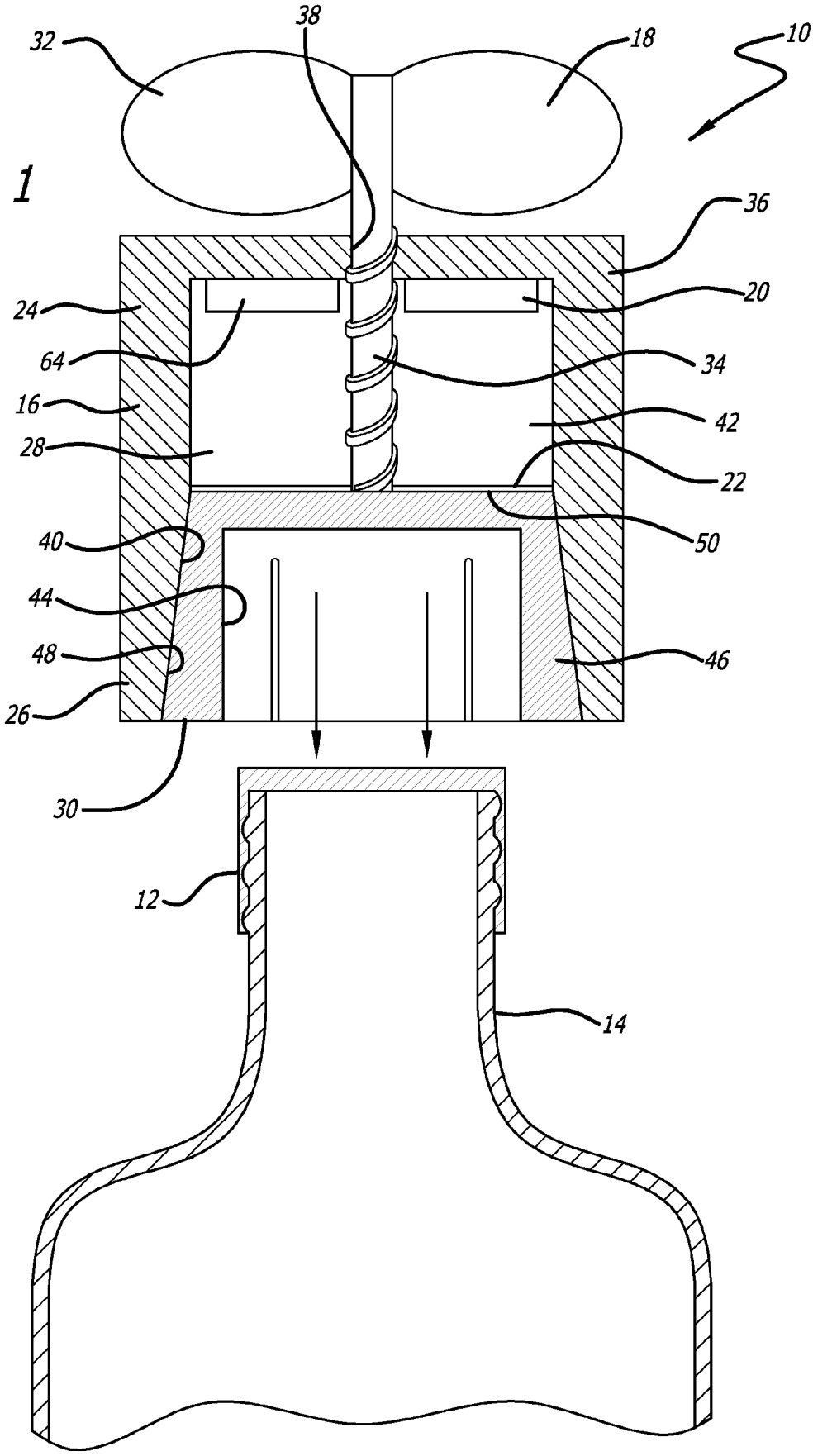
FIG. 1 is a partly-sectional partly-broken elevational view of an embodiment of a closure disconnecting and sound outputting article in proximity to a container with a closure thereon.

Referring to the drawings, in which like reference numerals refer to like or corresponding parts, the container closure disconnecting and sound-outputting article 10 according to the invention enables disconnection of a closure such as a screw cap 12 from a container such as a wine bottle 14, and the output of sound upon such disconnection. The article 10 includes a closure capture enabling element 16, for enabling capture of the screw cap 12, and a handle 18, connected to the closure capture enabling element 16, for enabling movement of the closure capture enabling element 16 for capture, disconnection, and removal of the screw cap 12 from the wine bottle 14. The article 10 also includes a sound outputting circuit 20, for enabling sound to be outputted upon capture and movement of the screw cap 12 in a direction for enabling disconnection of the screw cap 12 from the wine bottle 14, and a sound outputting actuation enabling element 22, for enabling actuation of the sound outputting circuit 20. The article 10 is reuseable, and does not contact the beverage in the container 14.

The sound outputting actuation enabling element 22 may comprise a contact element and the sound outputting circuit enables sound to be outputted upon capture and disconnection of the screw cap 12 from the wine bottle 14, and movement of the contact element 22 into contact with the sound outputting circuit 20. The sound outputting actuation enabling element 16 may alternatively comprise a button (FIG. 5) for enabling manual actuation of the sound outputting circuit 20. The sound which is able to be outputted by the sound outputting circuit 20 upon actuation thereof by contact of the contact element 22 with the sound outputting circuit 20 may comprise the sound of a cork popping out of a wine bottle.

Figure 2:
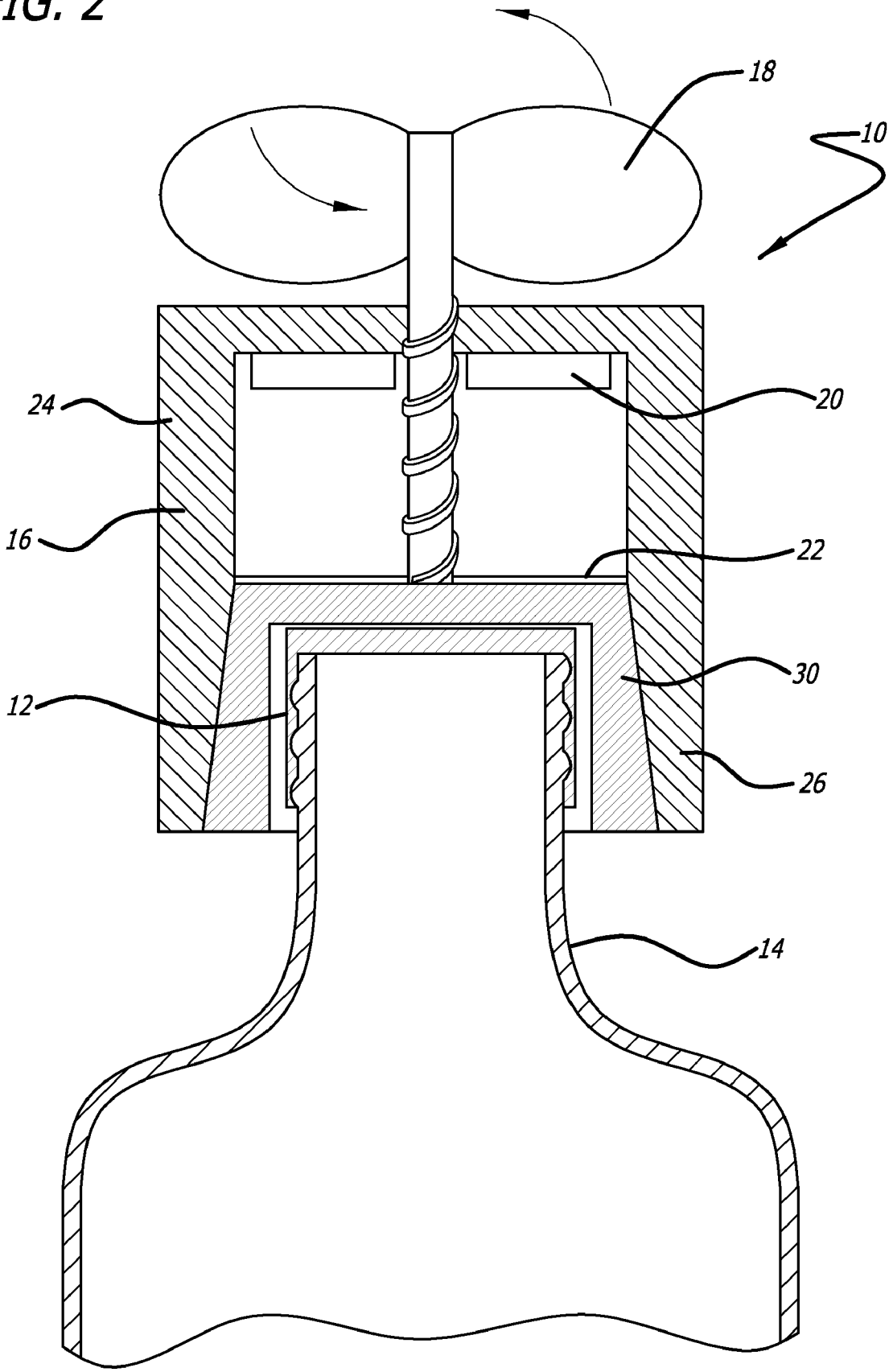
FIG. 2 is a similar view of the article positioned so as to cover the closure.
Figure 3:
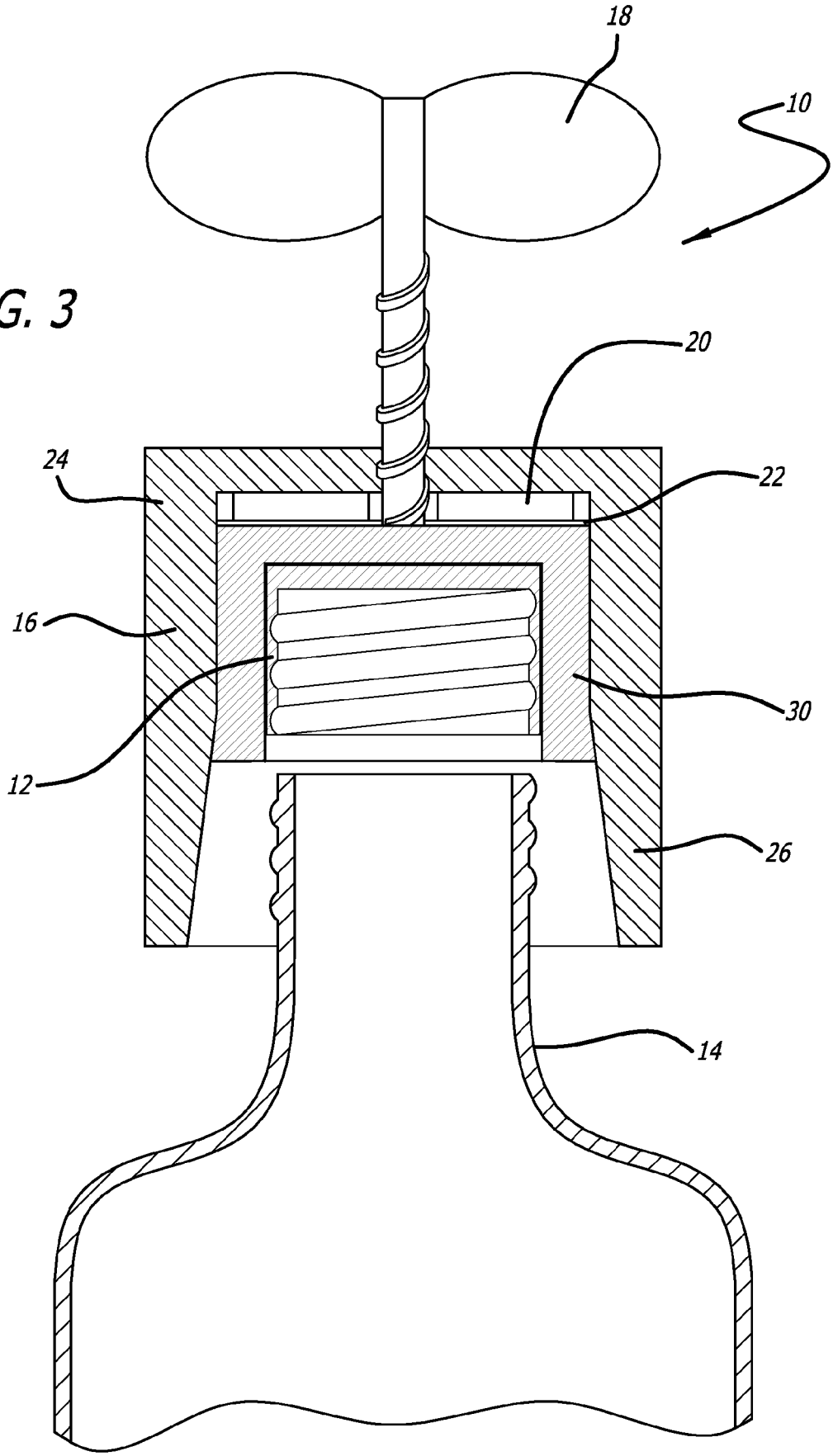
FIG. 3 is a similar view of the closure disconnected from the container by the article.

FIGS. 1-3 present an article 10 in accordance with the invention which includes a closure capture enabling element 16, comprising a closure capturing and removing enabling element, which includes a housing 24 to enable the handle 18 to interact therewith for enabling capture, disconnection, and removal of the closure 12 from the container 14. The housing 24 includes an outer housing 26 which has an inner chamber 28, and an inner housing 30, able to capture and move with the closure 12 in the outer housing inner chamber 28 to enable removal of the closure 12. The handle 18 includes a gripping portion 32, and a threaded shaft 34 extending from the gripping portion 30, which is connected to, and operable in connection with, the closure capture enabling element 16. The housing 24 also includes a top portion 36 having a threaded opening 38 through which the handle threaded shaft 34 is extendable.

The housing inner chamber 28 includes a lower portion 40, in which the inner housing 30 is positioned, and an upper portion 42, into which the inner housing 30 is movable responsive to the turning of the handle gripping portion 32 and the threaded shaft 34. The outer housing 26 includes an inner surface 44, the inner housing 30 includes a bottom portion 46, and the diameter of the outer housing inner surface 44 is reduced relative to the outer diameter of the bottom portion 46 of the inner housing 30. The diameter of the inner housing inner surface 44 is such that the inner housing 30 is able to fit around and over the closure 12. Also, the inner housing 30 is comprised of a flexible material. The inner housing 30 includes an outer surface 48 which is upwardly tapered. The inner housing 30 includes a top surface 50, and the sound outputting actuation enabling element 22 is mounted on the inner housing top surface 50.

Figure 4:
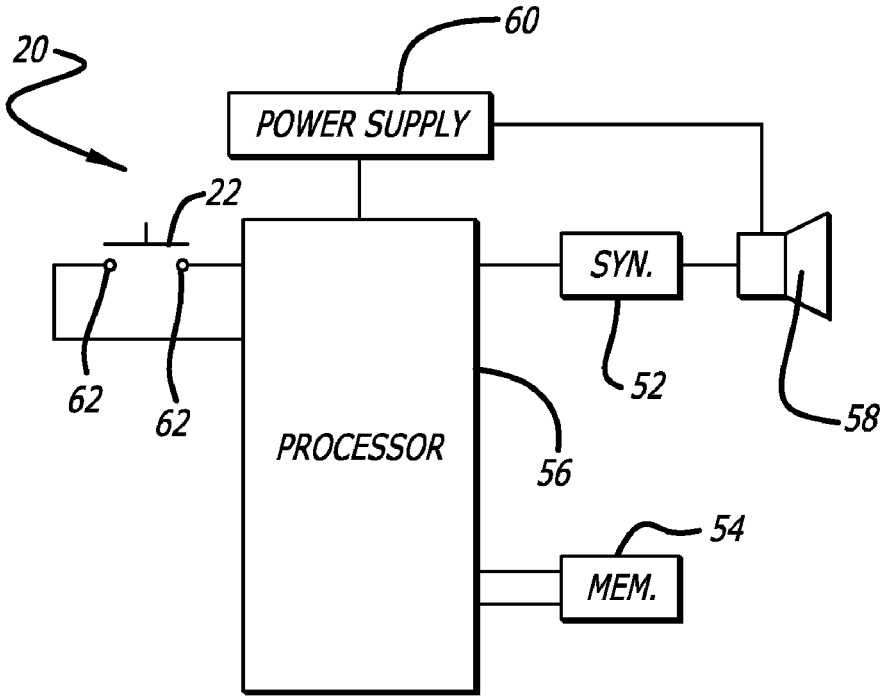
FIG. 4 is a circuit diagram of a sound outputting circuit in the article.

Referring to FIG. 4, the sound outputting circuit 20 includes a sound synthesizer 52, for enabling the outputting of sound signals, a memory 54, operably connected to the sound synthesizer 52, which contains sound data, and a processor 56, operably connected to the sound synthesizer 52 and the memory 54, configured to control the sound synthesizer 52 in the generation of the sound data from the sound data selected from the memory 54. Also, the sound outputting circuit 20 includes a speaker 58, operably connected to the sound synthesizer 52 to reproduce sounds based upon the sound signals outputted by the sound synthesizer 52, a power supply 60, which may comprise a battery, for supplying power to the sound outputting circuit 20, and switch connections 62, which are normally in an open sound outputting circuit mode, and which are able to be contacted by the contact element 22 to generate a closed sound outputting circuit mode. The sound outputting circuit 20 may further include a memory chip, for enabling the recording of a user-recordable output such as a user message, to enable a user-recordable sound to be input therein and output therefrom.

The sound outputting circuit 20 may be encased in a casing 64, which is generally disk-shaped. The sound outputting circuit 20 may alternatively be mounted in the handle 18. Alternatively, the closure 10 may include a slot for enabling insertion and removal of the power supply battery, enabling the use of a replaceable power supply. The sound outputted by the sound outputting circuit 20 may comprise a cork popping upon being removed from a wine bottle, another pre-recorded sound such as an advertising or promotional message, nutritional information, or a user-recordable output, which may comprise a user message. The sound may be recorded on a chip, which may enable recording for example for time periods from one second to one minute.

Figure 5:
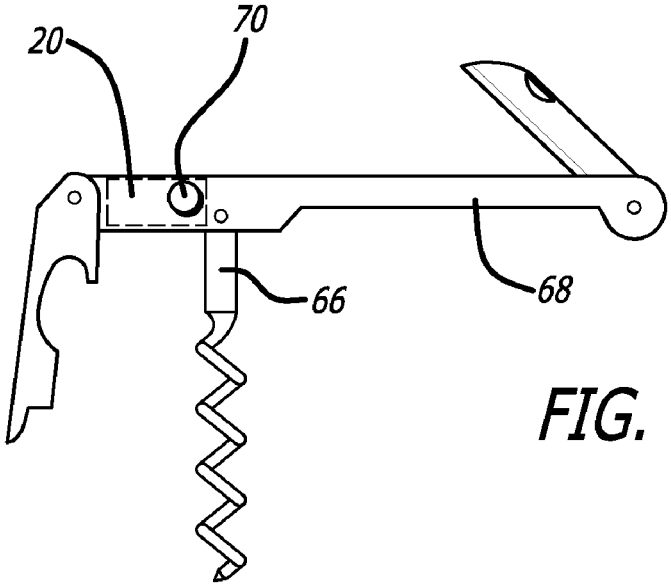
FIG. 5 is an elevational view of another embodiment of the article.

There is shown in FIG. 5 another embodiment of the invention, which includes an article 10 for enabling disconnection of a closure from a container and the output of sound thereupon, comprising a closure disconnection enabling element 66, for enabling disconnection of the closure, and a handle 68, connected to the closure disconnection enabling element 66, for enabling movement of the closure capture enabling element 66 for disconnection and removal of the closure thereby relative to the container. It further includes a sound outputting circuit 20, for enabling sound to be outputted upon capture and movement of the closure in a direction for enabling disconnection of the closure from the container, mounted in the handle 68, and a sound outputting actuation enabling element 70, for enabling actuation of the sound outputting element, mounted in the handle 68. The closure disconnection enabling element 66 may comprise a corkscrew device, including an open spiral helix metal spike, operable in conjunction with the handle 68. The sound outputting actuation enabling element 70 may comprise a button for enabling manual actuation of the sound outputting circuit 20.

In a further embodiment of the invention, the closure capture enabling element may include a sheath, and a closure capturing and pulling enabling element, extending from and movable relative to the sheath so as to enable capture, disconnection, and removal of the closure from the container. The sheath may include an upper end and a lower end, and may be tapered so as to be narrower at the upper end and wider at the lower end, to enable capture the closure upon movement of the closure capture and pulling enabling element relative to the sheath. The closure capturing and pulling enabling element may comprise a plurality of gripping elements. The plurality of gripping elements may be comprised of a flexible material. The flexible material may comprise rubber or plastic.

Upon capture of the closure and movement of the handle, the closure capturing and pulling enabling element moves into the sheath so as to enable disconnection and removal of the closure. The handle may include an extending element for enhancing gripping for movement thereof The handle may be rotatable, upon capture of the closure, to enable disconnection and removal of the closure. The handle may include a spring-loaded ratchet element for enabling movement of the closure capture enabling element. The closure capturing and pulling enabling element may be secured to the handle for movement therewith. The closure capture enabling element may be able to capture the closure with a friction fit thereagainst.

While the particular article as shown and disclosed in detail herein is fully capable of obtaining the objects and providing the advantages previously stated, it is to be understood that it is merely illustrative of the presently preferred embodiment of the invention, and that no limitations are intended to the details of construction or design shown herein other than as described in the appended claims.

We claim:

1. An article for enabling disconnection of a closure from a container, and the output of sound thereupon, comprising:

a closure capture enabling element, for enabling capture of the closure;

a handle, connected to the closure capture enabling element, for enabling movement of the closure capture enabling element for capture, disconnection, and removal of the closure thereby relative to the container;

an electronic sound outputting circuit, for enabling sound to be outputted electronically upon capture and movement of the closure by movement of the handle in a direction for enabling disconnection of the closure from the container; and a sound outputting actuation enabling element, connected to the closure capture enabling element and able to interact with the electronic sound outputting circuit upon movement of the handle, for enabling actuation of the electronic sound outputting circuit interactively upon movement of the handle and connection thereby of the sound outputting actuation enabling element to the electronic sound outputting circuit.

2. An article as in claim 1, wherein the closure comprises a screw cap, the closure capture enabling element enables capture and disconnection of the screw cap, the handle enables movement disconnection and removal of the screw cap, the sound outputting actuation enabling element comprises a contact element, and the electronic sound outputting circuit enables sound to be outputted upon contact of the screw cap with the contact element and the electronic sound outputting circuit.

3. An article as in claim 1, wherein the container which the closure is connected to comprises a wine bottle, and the sound which is able to be outputted by the sound outputting circuit upon actuation thereof by the sound outputting actuation enabling element comprises the sound of a cork popping out of a wine bottle.

4. An article as in claim 1, wherein the closure capture enabling element comprises a closure capturing and removing enabling element, which includes a housing, able to enable the handle to interact therewith for enabling capture, disconnection, and removal of the closure from the container.

5. An article as in claim 1, wherein the closure capture enabling element is able to capture the closure with a friction fit thereagainst.

6. An article as in claim 1, wherein the handle is rotatable, upon capture of the closure, to enable disconnection and removal of the closure.

7. An article as in claim 1, wherein the sound outputting circuit includes a sound synthesizer, for enabling the outputting of sound signals, a memory, operably connected to the sound synthesizer, which contains sound data, a processor, operably connected to the sound synthesizer and the memory, configured to control the sound synthesizer in the generation of the sound data from the sound data selected from the memory, a speaker, operably connected to the sound synthesizer to reproduce sounds based upon the sound signals outputted by the sound synthesizer, a power supply, for supplying power to the sound outputting circuit, and switch connections, which are normally in an open sound outputting circuit mode, and which are able to be contacted by the switch to generate a closed sound outputting circuit mode.

8. An article as in claim 1, wherein the sound outputting circuit further includes a user-recordable output, for enabling a user-recordable sound to be input therein and output therefrom.

9. An article as in claim 1, wherein the sound outputting actuation enabling element comprises a contact element for enabling automatic actuation of the sound outputting element.

10. An article as in claim 1, wherein the sound outputting actuation enabling element comprises a button for enabling manual actuation of the sound outputting element.

11. An article as in claim 1, further including a casing in which the sound outputting circuit is enclosed.

12. An article as in claim 11, wherein the casing in which the sound outputting circuit is enclosed is generally disk-shaped.

13. An article as in claim 1, wherein the article is reuseable.

14. An article as in claim 1, wherein the article does not contact the beverage in the container.

15. An article as in claim 1, wherein the closure capture enabling element includes a sheath, and a closure capturing and pulling enabling element, extending from and movable relative to the sheath so as to enable capture, disconnection, and removal of the closure from the container.

16. An article as in claim 15, wherein the sheath includes an upper end and a lower end, and is tapered so as to be narrower at the upper end and wider at the lower end, so as to enable capture of the closure upon movement of the closure capture and pulling enabling element relative to the sheath.

17. An article as in claim 15, wherein, upon capture of the closure and movement of the handle, the closure capturing and pulling enabling element moves into the sheath so as to enable disconnection and removal of the closure.

18. An article as in claim 1, wherein the handle includes an extending element for enhancing gripping for movement thereof.

19. An article as in claim 4, wherein the housing in the closure capturing and removing element comprises a housing which includes an outer housing which has an inner chamber, and an inner housing, able to capture and move with the closure in the outer housing inner chamber to enable removal of the closure.

20. An article as in claim 19, wherein the housing inner chamber includes a lower portion, in which the inner housing is positioned, and an upper portion, into which the inner housing is movable responsive to turning the gripping portion and the threaded shaft of the handle.

21. An article as in claim 20, wherein the lower portion of the housing outer portion inner chamber is upwardly tapered.

22. An article as in claim 19, wherein the outer housing includes an inner surface, which has a diameter which is reduced relative to the outer diameter of the bottom portion of the inner housing.

23. An article as in claim 19, wherein the inner housing includes an inner surface, the diameter of which is such that the inner housing is able to fit around and over the closure.

24. An article as in claim 19, wherein the inner housing is comprised of a flexible material.

25. An article as in claim 19, wherein the inner housing includes an outer surface which is upwardly tapered.

26. An article as in claim 19, wherein the inner housing includes a top surface, and the sound outputting actuation enabling element is mounted on the inner housing top surface.

27. An article as in claim 4, wherein the handle includes a gripping portion, and a threaded shaft extending from the gripping portion which is connected to, and operable in connection with, the closure capture enabling element.

28. An article as in claim 27, wherein the housing includes a top portion having a threaded opening through which the handle threaded shaft is extendable.

29. An article as in claim 4, wherein the closure capturing and removing enabling element is secured to the handle for movement therewith.

* * * * *